United States Patent [19]

Kramer

[11] Patent Number: 4,492,256

[45] Date of Patent: Jan. 8, 1985

[54] EXTRUDED HEDDLE ROD AND CAP

[75] Inventor: Charles F. Kramer, Greenville, S.C.

[73] Assignee: Steel Heddle Manufacturing Company, Greenville, S.C.

[21] Appl. No.: 393,635

[22] Filed: Jun. 30, 1982

[51] Int. Cl.[3] ..... D03D 9/00

[52] U.S. Cl. ..... 139/92

[58] Field of Search ..... 139/91, 92

[56] References Cited

U.S. PATENT DOCUMENTS

| | | | |
|---|---|---|---|
| 2,482,149 | 9/1949 | Blickenstorfer | 139/92 |
| 3,754,577 | 8/1973 | Heller | 139/92 |
| 4,106,530 | 8/1978 | Kaufmann | 139/92 |
| 4,387,742 | 6/1983 | Graf | 139/92 |

FOREIGN PATENT DOCUMENTS

| | | | |
|---|---|---|---|
| 305164 | 2/1973 | Austria | 139/92 |
| 2058855 | 4/1981 | United Kingdom | 139/92 |

*Primary Examiner*—Henry S. Jaudon

*Attorney, Agent, or Firm*—Dority & Manning

[57] ABSTRACT

A heddle frame 10 for a loom is disclosed which includes an extruded, light frame slat 12 and heddle rod 20 construction wherein a hardened metal cap B is received over outer free ends 40, 42 of the heddle rod 20. Cap B includes rear and forward wear surfaces 44, 46 which protrude past planar surfaces 30, 32 of a web portion 26 to take the wear and hold the opposing interior surfaces of the end slots *24a, 24b* of the heddles 24 out of contact with the soft material of the web portion. Cap B is formed of resilient legs 58, 60 which provide a mechanical clamp when received over the free ends of the heddle rod.

9 Claims, 4 Drawing Figures

EXTRUDED HEDDLE ROD AND CAP

BACKGROUND OF THE INVENTION

The invention relates to a construction for a heddle frame which includes top and bottom frame slats each of which has a heddle rod attached thereto which supports heddles in the frame. The heddles include central thread eyes in which the individual warp yarn ends are held during shedding on the loom. The heddles are typically constructed of metal and are fastened to the heddle rod by means of end slots in which the heddle rod is received.

There is considerable wear and noise between the heddle rod and the end slots of the heddles during the rapid reciprocation of the heddle frame during shedding due to the space and play between the heddles and heddle rod as a tight fit is not possible. This play and wear therebetween become attenuated in heddle frames utilized on high speed shuttleless looms where the reciprocating motion during shedding occurs most rapidly. Because of the high speed performance and rapid lifting cycles during shedding, the frame must be as light in weight as possible without sacrificing structural integrity.

Typically, the frame slat is extruded from aluminum for light weightness. The heddle rod is about seven-eights of an inch in height and constructed from a hardened steel to reduce wear of the heddle rod. The heddle rod is normally riveted to the frame slat about every three and one-half inches along the length of the heddle rod which may be upwards to twelve feet. Maintaining the heddle rod straight across the frame slat during riveting is a time consuming problematic process. Furthermore, the rivet connections are susceptible to loosening in high speed operation which can lead to force attenuation and undamped vibrations resulting in parts failure. To extrude the heddle rod as one-piece with the frame slat results in wear problems since the soft aluminum material of the heddle rod would wear excessively in contact with the heddle slot.

It has been proposed in German Pat. No. 2,933,442 to make a one-piece frame slat and heddle rod constructed from a soft material to which is glued a hard steel rail covering.

It has been proposed in the prior art to construct a heddle rod from a lightweight fiber reinforced plastic bonded to a light weight frame constructed from aluminum or other light material (U.S. Pat. No. 3,754,577). It has also been proposed to apply a metal or ceramic plating to those regions of the heddle rods subjected to wear (British Pat. No. 1,308,326).

In U.S. Pat. No. 4,106,530, it has been proposed to cover a lightweight metal heddle rod with a synthetic plastic material which is resistant to impact and wear at the locations of impact with the heddle rod slot and to provide such a covering which can be replaced and renewed.

However, the various platings and coverings heretofore utilized in heddle rod constructions have not been entirely satisfactory and have left parts of the heddle rod uncovered and exposed to wear and noise. Retention of the various platings and coverings under high dynamic forces has also been a problem to which much attention need be given.

Accordingly, an important object of the present invention is to provide an improved heddle frame construction wherein connection problems in alignment and riveting of the heddle rod to the frame slat are virtually eliminated.

Another important object of the present invention is to provide a one-piece frame slat and heddle rod construction of a light material having improved wear characteristics.

Still another important object of the present invention is to provide a heddle rod having its wear surfaces reinforced with a covering having improved retention characteristics.

Still another important object of the present invention is to provide a wear and noise resistant heddle rod construction.

SUMMARY OF THE INVENTION

It has been found according to the present invention that an extruded frame slat and heddle rod construction can be had which eliminates the alignment and assembly problems inherent in two-piece constructions. The extruded construction is made wear resistant and less susceptible to fatigue by means of providing a heddle rod which includes a web portion having rearward and forward planar surfaces defining a predetermined thickness and by covering the free outer edges of the heddle rod with a wear resistant cap having a continuous wear resistant surface. The wear surface of the cap includes rear and forward wear surfaces extending in a plane beyond the plane of the rear and forward planar surfaces of the web portion of the heddle rod. The interior surfaces of the end slot of the heddle are thus maintained out of contact with the soft web portion of the heddle rod as bearing against the wear surfaces of the cap only. In a preferred embodiment the free outer edges of the heddle rod are reduced in their thickness as compared to the web portion of the heddle rod to thereby provide space for the material thickness of the cap.

The cap is advantageously made by roll forming a hardened strip of metal into an inverted U-shape where the free ends of the U-shaped cap are spaced apart a distance less than the thickness of the free ends of the heddle rod over which the cap member is received. By this means, a mechanical clamp is provided between the cap and the heddle rod to aid in retaining the cap thereon.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
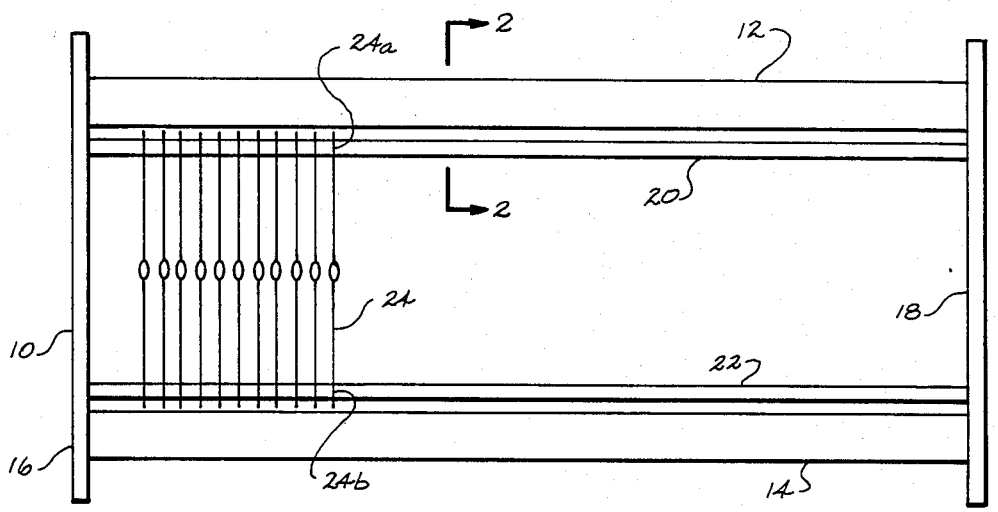
FIG. 1 is a front elevation of a heddle frame which includes a frame slat and heddle rod construction according to the invention supporting heddles in the frame.
Figure 2:
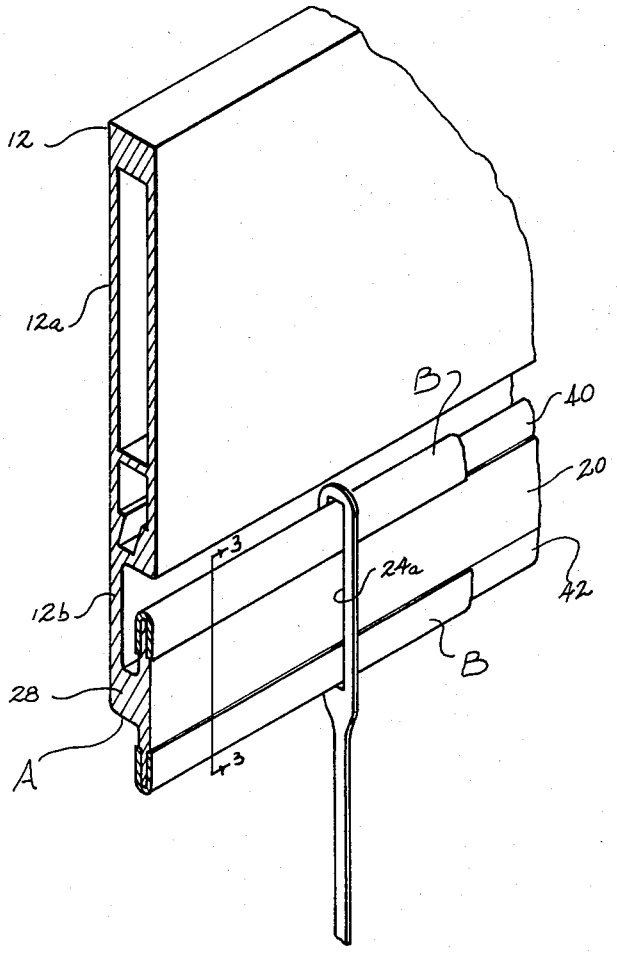
FIG. 2 is a partial perspective view of an extruded frame slat and heddle rod having a metal cap covering the outer free ends of the heddle rod as constructed according to the present invention.

The invention is concerned with a heddle frame for use on a loom of the type which includes top and bottom frame slats and a heddle rod which is attached to each frame slat which support heddles in the frame. Since the construction of looms and associated heddle frames and their operation are well known, only so much of a loom and associated heddle frame are illustrated herein as is necessary of an understanding of the invention. For example, the drive which reciprocates the heddle frame up and down during shedding operations on a loom is well known and accordingly, only the heddle frame itself is illustrated in the drawings since the invention particularly pertains to the construction of the heddle rod and the frame slat.

Referring now in more detail to the drawings, a heddle frame 10 is illustrated which includes a top frame slat 12 and a bottom frame slat 14 carried by side frame members 16 and 18 in any suitable manner. Carried on the top frame slat is a top heddle rod 20 and a bottom heddle rod 22 is carried by the bottom frame salt 14. A heddle 24 is supported between the top and bottom heddle rods 20 and 22 in the frame 10 by means of top and bottom end slots **24*a* and 24*b*, repsectively. Since the construction of the top and bottom frame slats and heddle rods may be identical, the remainder of the description of the invention will be made in reference to the top frame slat and heddle rod construction only. It being understood that the bottom frame slat and heddle rod may have a like construction and function for receiving the bottom end slot 24*b***.

Frame slat 12 includes a hollow body portion **12*a* and a depending flange portion 12*b* which extend across the width of the frame slat 12 and a provides integral connection with the heddle rod 20. In a preferred form of the invention, the frame slat 12 and heddle rod 20** are extruded as one-piece from aluminum or lightweight aluminum alloy.

Heddle rod 20 includes a main body portion A and cap means B. The main body A is the uncapped portion of the heddle rod 20 which includes an intermediate web portion 26 which is connected to the flange **12*b* of frame slat 12 by means of a connecting portion 28 connecting the heddle rod 20 to the frame slat. The intermediate web portion 26 is carried transverse to the connecting portion 28 and extends past the connection portion in opposing directions. The web portion includes a rearward planar surface 30 and a forward planar surface 32 which defines a predetermined thickness 34. The intermediate web portion terminates in shoulder means 36 and 38 formed on the opposing ends of the intermediate web portion 26 which extend inwardly of the rear and forward planar surfaces of the web portion terminating the same at each end thereof. A reduced free end 40 and 42 extends from the shoulder means on the opposing ends of intermediate web portion 26. The reduced free ends 40 and 42 are reduced in thickness 43 with respect to the thickness 34 of the web portion of the heddle rod. The free ends terminate in free outer edges 40*a* and 42*a***, *respectively.*

Figure 3:
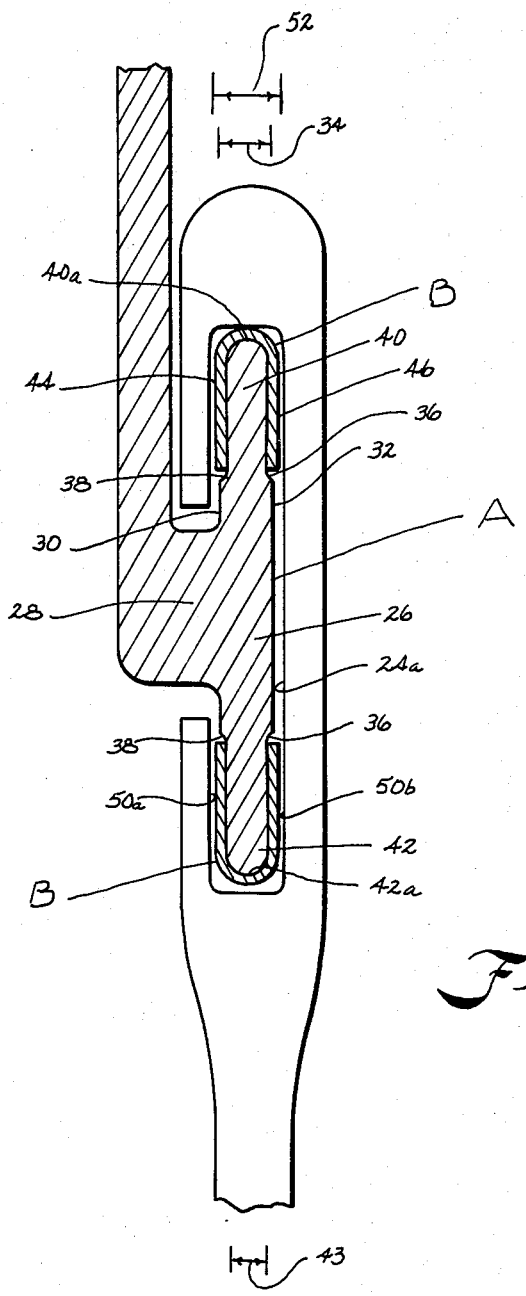
FIG. 3 is a sectional view taken along line 3—3 of FIG. 2.
Figure 4:
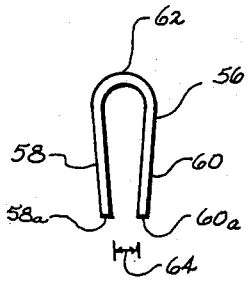
FIG. 4 is an end elevation of a protective cap member constructed according to the present invention in an unstressd state.

The cap means B is carried on the free ends 40, 42 of the web portion 26 covering the outer free edges **40*a*, 42*a* and wrapping around the outer free ends to form rear and forward wear surfaces 44 and 46. The rear and forward wear surfaces 44 and 46 assume a generally parallel relationship with the rear and forward planar surfaces 30 and 32 of the web portion 26. The cap means is dimensioned with respect to the web portion 26 so that the rear and forward wear surfaces lie in a plane (vertical when on the loom) beyond that of a plane of the rear and forward planar surfaces of the web portion so that interior surface of the end slot 24*a* of the heddle 24 contacts the wear surfaces 44 and 46 and is held generally out of contact with the main body A of the heddle rod. As can best be seen in FIG. 3, the exterior thickness 52 of the cap means B is greater than the exterior thickness of the planar surfaces 30 and 32 of the web portion 26 so that the interior surfaces 50*a* and 50*b* of the heddle end slot 24*a* is kept out of contact with the planar surfaces of the web portion of the heddle rod when supported thereon. In this manner, the extruded light material of the heddle rod 20** is not subjected to wear which is taken by the cap covering B.

In practice, the heddle rod 20 may be extruded from aluminum or other suitable light material as one piece with the frame slat 12 and the cap covering B may be made from a hardened steel.

Cap means B is illustrated in the form of an inverted U-shaped cap member 56 having a pair of legs 58 and 60 which terminate at free ends **58*a* and 60*a*. A curved shank portion 62 joins the legs 58 and 60. It is preferred that the cap member be roll formed by a conventional metal rolling process from a hardened steel strip since it has been found that heat treating causes unacceptable distortions in the cap shape which thus results in improper fitting and retention on the free end of the heddle rod. The free ends 58*a* and 60*a* are spaced a distance 64 apart such that the legs 58 and 60 are resiliently separated to be received over the free ends 40 and 42 of the heddle rod. In this manner a mechanical clamp is provided between the cap member 56** and the free end of the heddle rod which aids in the retention of the cap member on the heddle rod. In addition, suitable adhesives may be utilized for aiding in retention such as a hot melt adhesive.

Thus it can be seen that a highly advantageous construction can be had for a lightweight frame slat and heddle rod having improved wear and noise characteristics according to the invention. The free ends 40 and 42 of the heddle rod are preferably reduced in their thickness relative to the intermediate web 26 of the heddle rod. This results in a more rigid heddle rod. In addition, this allows for accommodating end slot openings of conventionally sized heddles.

While a preferred embodiment of the invention has been described using specific terms, such description is for illustrative purposes only, and it is to be understood that changes and variation may be made without departing from the spirit of scope of the following claims.

What is claimed is:

1. In a heddle frame having top and bottom frame slats, a heddle rod carried by each said frame slat, and heddles supported on said heddle rods in said heddle frame having end slots received over said heddle rods, a frame slat and heddle rod construction comprising:

connecting means connecting said heddle rod to said frame slat;

a web portion carried transverse to said connecting means extending past said connecting means in opposing directions;

a web portion having a rear planar surface and a forward planar surface opposite said rear planar surface defining a predetermined thickness therebetween;

said web portion extending transversely past said connector means terminating in remote free ends having outer free edges;

cap means having spaced legs carried on said free ends of said web portion covering said outer free edges and wrapping around said outer free edges to form rear and forward wear surfaces having a generally parallel relationship with said rear and forward planar surfaces of said web portion of said heddle rod; and said legs of said cap means and said free ends of said heddle rod having a total thickness greater than said web portion so that said rear and forward wear surfaces project beyond said rear and forward planar surfaces of said web portion so that opposing interior surfaces of said heddle eye slot contact said wear surfaces and are held thereby generally out of contact from said rear and forward planar surfaces of said web portion of said heddle rod.

2. The apparatus of claim 1 wherein said free ends of said web portion are reduced in thickness with respect to said thickness of said web portion as defined by said rear and forward planar surfaces so that the overall weight of said heddle rod is reduced while said wear surfaces of said cap means project beyond said web portion.

3. The apparatus of claim 1 wherein said heddle rod comprising said connector means, web portion and free ends is formed as one-piece with said frame slat.

4. The apparatus of claim 3 wherein said heddle rod and frame slat are extruded from aluminum.

5. The apparatus of claims 3 or 4 wherein said cap means is constructed from a hardened steel.

6. The apparatus of claim 1 wherein said cap means includes a metallic U-shaped member having resilient legs, free ends of said legs being spaced apart a distance less than the thickness of said free ends of said heddle rod in an unstressed state to form a mechanical clamp when received over said free ends of said heddle rod assisting in the retention of said cap means thereon.

7. In a heddle frame having top and bottom frame slats, a heddle rod carried by each said frame slat, and heddles supported on said heddle rods in said heddle frame having end slots received over said heddle rods, a frame slat and heddle rod construction comprising:

connecting means connecting said heddle rod to one of said frame slats;

an intermediate web portion carried transverse to said connecting means extending past said connecting means in opposing directions.

said web portion having a rear planar surface integrally connected with said connecting means and a forward planar surface opposite said rear planar surface defining a predetermined thickness therebetween;

said web portion extending transversely past said connector means;

shoulder means formed on opposing ends of said intermediate web portion extending inwardly of said rear and forward planar surfaces of said web portion;

a reduced free end extending from said shoulder means on said opposing ends of said intermediate web portion being reduced in thickness with respect to said web portion, said free ends terminating in a free outer edge;

cap means having spaced legs carried on said free ends of said web portion covering said outer free edges and wrapping around said outer free edges to form rear and forward wear surfaces having a generally parallel relationship with said rear and forward planar surfaces of said web portion of said heddle rod; and said legs of said cap means and reduced free ends of said heddle rod having a total thickness greater than said web portion so that said rear and forward wear surfaces project beyond said rear and forward planar surfaces of said web portion so that opposing interior surfaces of said heddle eye slot are held generally out of contact from said rear and forward planar surfaces of said web portion of said heddle rod.

8. The apparatus of claim 7 wherein said heddle rod comprising said connector means, web portion, shoulder means, and free ends is formed as one-piece with said frame slat.

9. The apparatus of claim 7 wherein said cap means includes a metallic U-shaped member having resilient legs, free ends of said legs being spaced apart a distance less than the thickness of said free ends of said heddle rod in an unstressed state to form a mechanical clamp when received over said free ends of said heddle rod assisting in the retention of said cap means thereon.

* * * * *